US009801440B2

(12) United States Patent
Hogan et al.

(10) Patent No.: US 9,801,440 B2
(45) **Date of Patent: *Oct. 31, 2017**

(54) EXPANDABLE AND ROTATABLE LUGGAGE

(71) Applicant: Briggs & Riley Travelware, LLC, Hauppauge, NY (US)

(72) Inventors: Donald Hogan, Bayshore, NY (US); Georgene Rada, Northport, NY (US); Jessica LoVerso, Bay Shore, NY (US); Matthew Dierkes, Mount Sinai, NY (US); Richard Krulik, Northport, NY (US); Tsung-Ming (Min) Kung, Taipei (R.O.C) (TW)

(73) Assignee: BRIGGS & RILEY TRAVELWARE, LLC, Hauppauge, NY (US)

( * ) Notice: Subject to any disclaimer, the term of this patent is extended or adjusted under 35 U.S.C. 154(b) by 186 days.

This patent is subject to a terminal disclaimer.

(21) Appl. No.: 14/273,125

(22) Filed: May 8, 2014

(65) Prior Publication Data

US 2014/0353103 A1 Dec. 4, 2014

Related U.S. Application Data

(63) Continuation-in-part of application No. 13/694,191, filed on Nov. 5, 2012, now Pat. No. 9,560,902.

(Continued)

(51) Int. Cl.
*A45C 5/14* (2006.01)
*A45C 7/00* (2006.01)

(52) U.S. Cl.
CPC ..... *A45C 7/0022* (2013.01); *A45C 5/14* (2013.01)

(58) Field of Classification Search
CPC ..... A45C 7/0022; A45C 5/14; Y10T 16/1853; B60B 33/0023; B60B 33/0042
See application file for complete search history.

(56) References Cited

U.S. PATENT DOCUMENTS 440,278 A 11/1890 Payntar
4,163,484 A * 8/1979 Delaney ..... A45C 13/42 190/115

(Continued)

FOREIGN PATENT DOCUMENTS

CN 102578779 A 7/2012
EP 1 649 772 A2 4/2006

(Continued)

OTHER PUBLICATIONS

International Search Report and Written Opinion dated Feb. 14, 2013 issued in PCT/US2012/063474.

(Continued)

*Primary Examiner* — Tri Mai
(74) *Attorney, Agent, or Firm* — Scully Scott Murphy and Presser

(57) ABSTRACT

A piece of luggage is provided. A main body and an expandable body of the luggage are connected to each other by a collapsible portion. The luggage has a cover pivotably connected to the expandable body. A first half of a zipper is fixed to the expandable body and a second half of the zipper is fixed to the cover. The engagement of the first half and the second half closes the cover to the expandable body, and thus a substantially enclosed space is defined by the main body, the expandable body and the cover. The luggage also has multiple rotational wheels mounted to the main body and/or the expandable body. The luggage stands on the rotational wheels and is rotatable with respect to one or more predetermined axes through these wheels.

8 Claims, 18 Drawing Sheets

Related U.S. Application Data

(60) Provisional application No. 61/628,725, filed on Nov. 4, 2011.

(56) References Cited

U.S. PATENT DOCUMENTS

| | | | | |
|---|---|---|---|---|
| 6,305,513 | B1 * | 10/2001 | Lu | A45C 5/14 190/103 |
| 6,390,259 | B1 | 5/2002 | Lu | |
| 6,408,997 | B1 * | 6/2002 | Chen | A45C 7/0022 190/103 |
| 6,591,950 | B1 * | 7/2003 | Scicluna | A45C 7/0027 190/103 |
| 7,832,533 | B2 * | 11/2010 | Selvi | A45C 3/001 190/103 |
| 9,560,902 | B2 * | 2/2017 | Hogan | A45C 7/0022 |
| 2002/0185350 | A1 | 12/2002 | Chang et al. | |
| 2003/0006110 | A1 * | 1/2003 | Lin | A45C 5/14 190/18 A |
| 2005/0067244 | A1 | 3/2005 | Smith et al. | |
| 2005/0072641 | A1 * | 4/2005 | Chen | A45C 13/36 190/37 |
| 2006/0070837 | A1 * | 4/2006 | King | A45C 7/0022 190/105 |
| 2006/0196743 | A1 * | 9/2006 | Lin | A45C 5/14 190/18 A |
| 2007/0151820 | A1 | 7/2007 | Lin et al. | |
| 2007/0175719 | A1 * | 8/2007 | Lai | A45C 5/02 190/115 |
| 2007/0209894 | A1 | 9/2007 | Selvi | |
| 2012/0005858 | A1 * | 1/2012 | Lai | B60B 33/0007 16/45 |
| 2012/0138403 | A1 * | 6/2012 | Tong | A45C 5/02 190/18 A |
| 2013/0092490 | A1 * | 4/2013 | Moon | A45C 7/0031 190/18 A |
| 2013/0140119 | A1 | 6/2013 | Hogan et al. | |
| 2014/0041978 | A1 * | 2/2014 | Chang | A45C 7/0018 190/18 A |
| 2014/0076679 | A1 * | 3/2014 | Hughes | A45C 13/262 190/18 A |

FOREIGN PATENT DOCUMENTS

| | | | |
|---|---|---|---|
| EP | 1649772 | * | 4/2006 |
| JP | 3077807 | | 3/2001 |
| JP | 2008515571 | A | 5/2008 |
| TW | 101201849 | | 2/2012 |
| TW | M431615 | U1 * | 6/2012 |
| WO | W02006039725 | A2 | 4/2006 |
| WO | WO2007079412 | A2 | 7/2007 |
| WO | 2013/028974 | A2 | 2/2013 |

OTHER PUBLICATIONS

Extended European Search Report dated Dec. 2, 2015 from related European Application No. 15 02 0067.3.

Chinese Office Action dated Apr. 23, 2015 from related Chinese Application No. 201280053342.9.

Supplementary European Search Report dated Jun. 10, 2015 from related European Application No. 12844818.0.

4th Office Action dated Jul. 15, 2016 issued in Chinese Application No. 201280053342.9.

Office Action issued in Korean Patent Application No. 10-2014-7015218 dated Nov. 16, 2016 :in English and Korean).

* cited by examiner

EXPANDABLE AND ROTATABLE LUGGAGE

CROSS REFERENCE TO RELATED APPLICATION

This application is related to and claims the benefits of U.S. patent application Ser. No. 13/694,191 filed Nov. 5, 2012 and U.S. Provisional Application No. 61/628,725 filed Nov. 4, 2011, the entire contents of which are incorporated by reference herein.

FIELD

The present disclosures relates generally to luggage, and more particularly, to luggage which has expandable features for allowing a user to selectively increase or decrease the capacity of the luggage and rotatable features for allowing the user to rotate the luggage with respect to one or more predetermined axes of the luggage to freely move the luggage.

BACKGROUND

Expandable luggage is designed to accommodate user's need for adjusting the capacity of the luggage. Typically, the expandable luggage has sections that can be expanded by unzipping the sections. With the expandable sections unzipped, the user will have additional storage space within the luggage. However, the zipping and unzipping operation can be cumbersome and the zippers of the sections are prone to breakage due to repetitive zipping and unzipping operations. In addition, wheeled luggage has been developed rapidly over the recent decades. Particularly, luggage having rollable or rotational wheels becomes popular. However, luggage, which can be expandable and rotatable while standing, has not been envisioned.

BRIEF SUMMARY

As described herein, the exemplary embodiments of the current invention overcome one or more of the above and other disadvantages known in the art. An exemplary aspect of the present invention relates to a piece of luggage. The luggage includes a main body and an expandable body. The expandable body includes a collapsible portion, through which the expandable body is connected to the main body. The luggage further includes an expansion and locking device configured to allow free movement of the expandable body in a compression direction towards the main body and configured to enable locking of the expandable body in an expanding direction away from the main body. A cover is pivotably connected to the expandable body. The luggage also includes a zipper having a first half connected to the expandable body and a second half connected to the cover. The engagement of the first half and the second half closes the cover with respect to the expandable body, such that a substantially enclosed space is defined by the main body, the expandable body and the cover. The luggage further includes a plurality of rotational wheels mounted to at least one of the main body and the expandable body. The luggage stands on the plurality of rotational wheels and is rotatable with respect to one or more predetermined axes through the plurality of rotational wheels.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, the drawings are merely intended to conceptually illustrate the structures and procedures described herein.

DETAILED DESCRIPTION OF EXEMPLARY EMBODIMENTS

FIGS. 1-8 illustrate a piece of luggage 1000 according to exemplary embodiment of the present disclosure. The luggage 1000 includes a main body 1100, an expandable body 1200 and a collapsible or foldable portion 1300 coupling the main body 1100 to the expandable body 1200. The luggage 1000 further includes an openable cover 1400 pivotably attached to the expandable body 1200 through, for example, a solid piece of flexible plastic, fabric or one or more hinges.

The cover 1400 can be closed in a substantially sealed manner by engagement of two halves of a zipper 1420 provided on the edge of the expandable body 1200 and the cover 1400, respectively. Once the cover 1400 is closed, the main body 1100, expandable body 1200, collapsible portion 1300 and cover 1400 collectively define a substantially enclosed space or cavity for receiving various articles.

Figure 1:
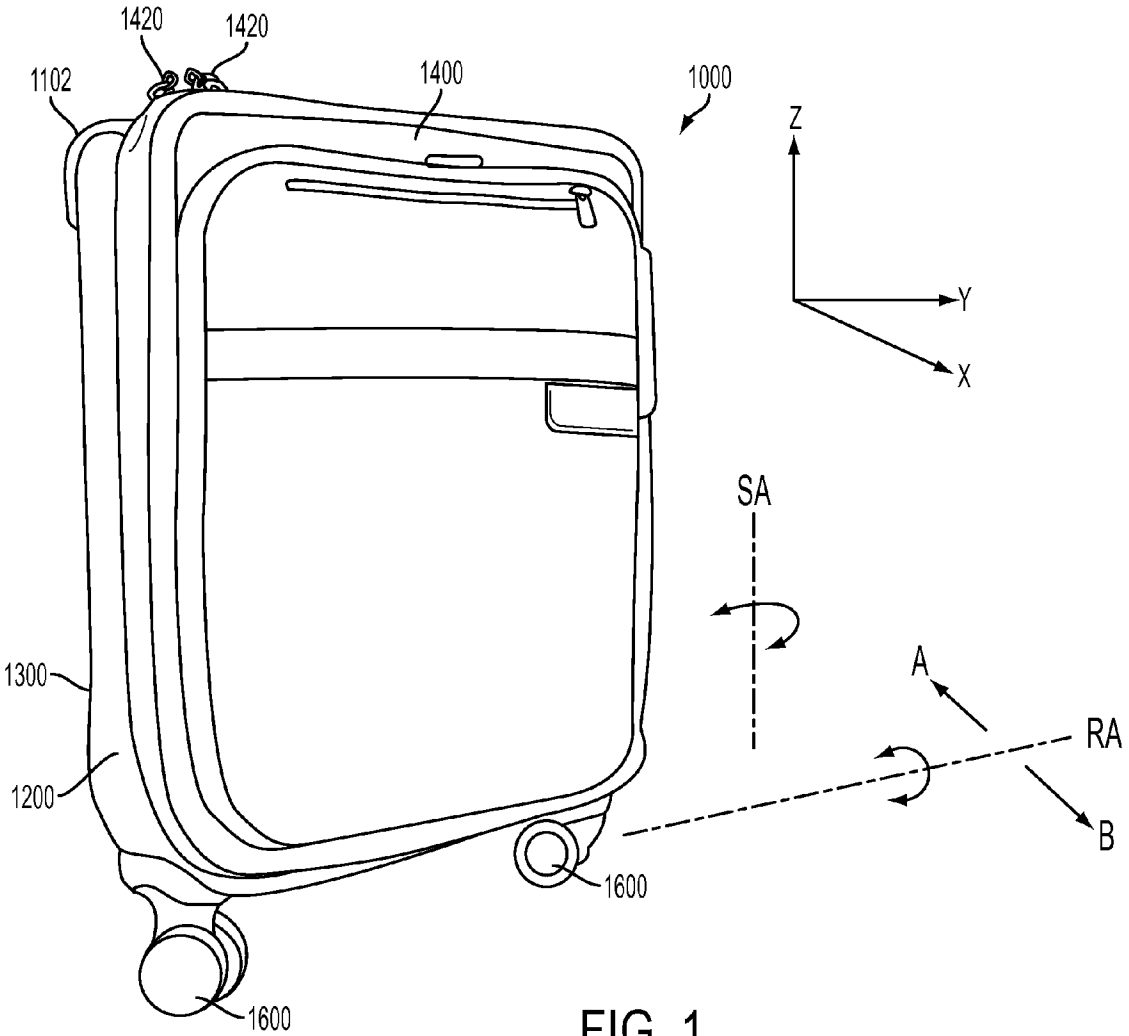
FIG. 1 is a perspective view of a piece of luggage according to an exemplary embodiment of the present disclosure.
Figure 2:
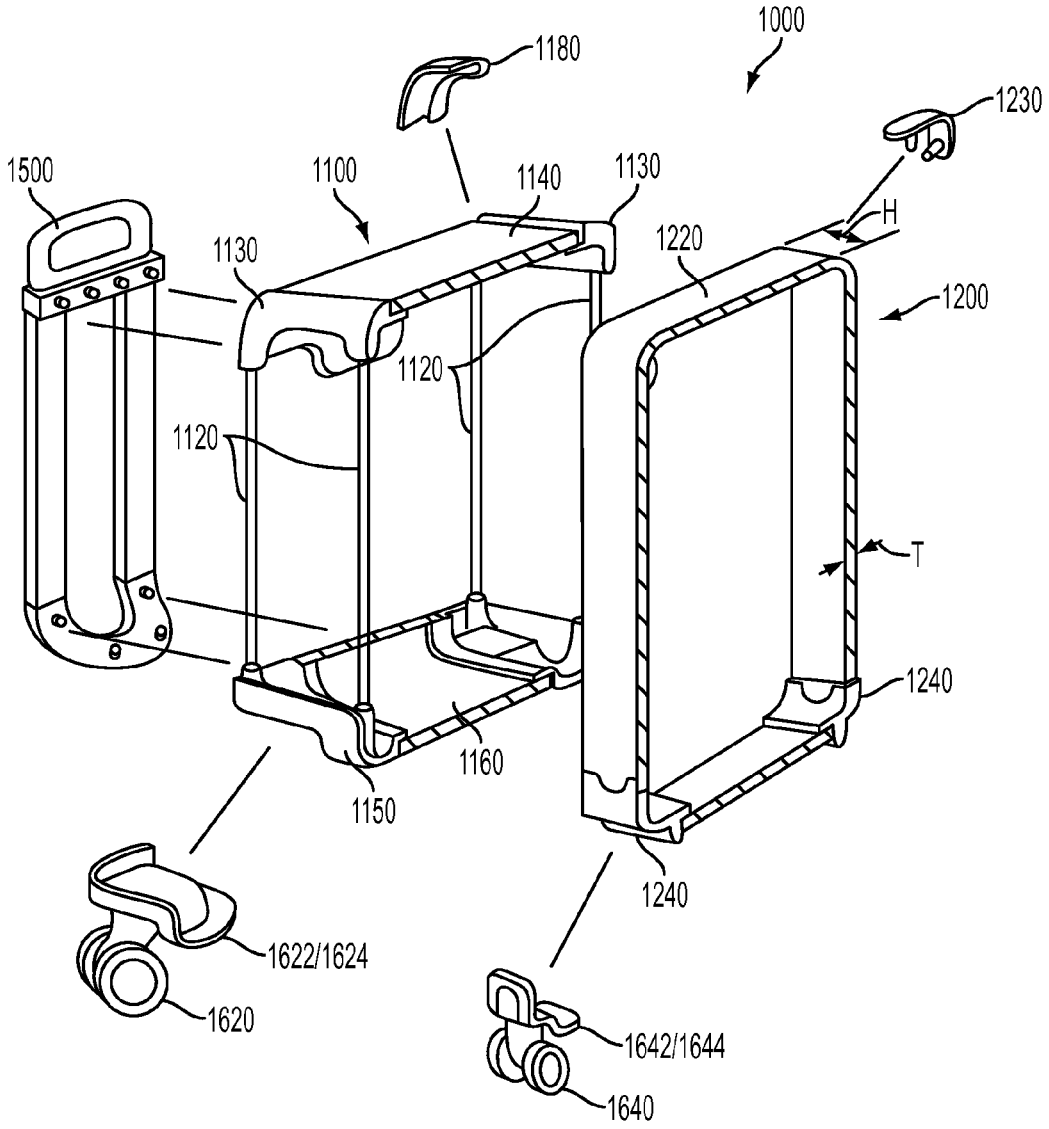
FIG. 2 is an exploded perspective view of the exemplary luggage.
Figure 3:
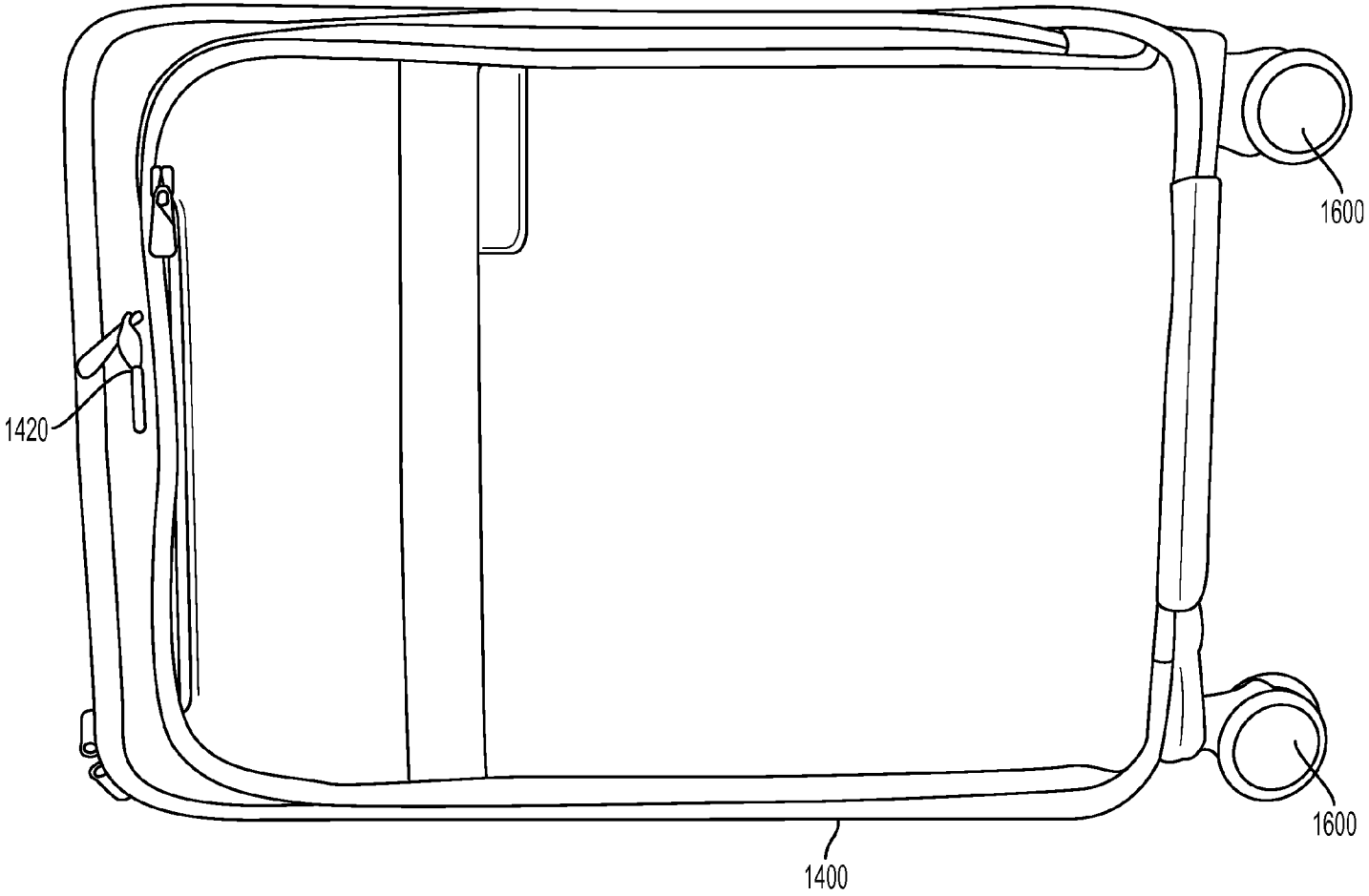
FIG. 3 is front view of the exemplary luggage.
Figure 4:
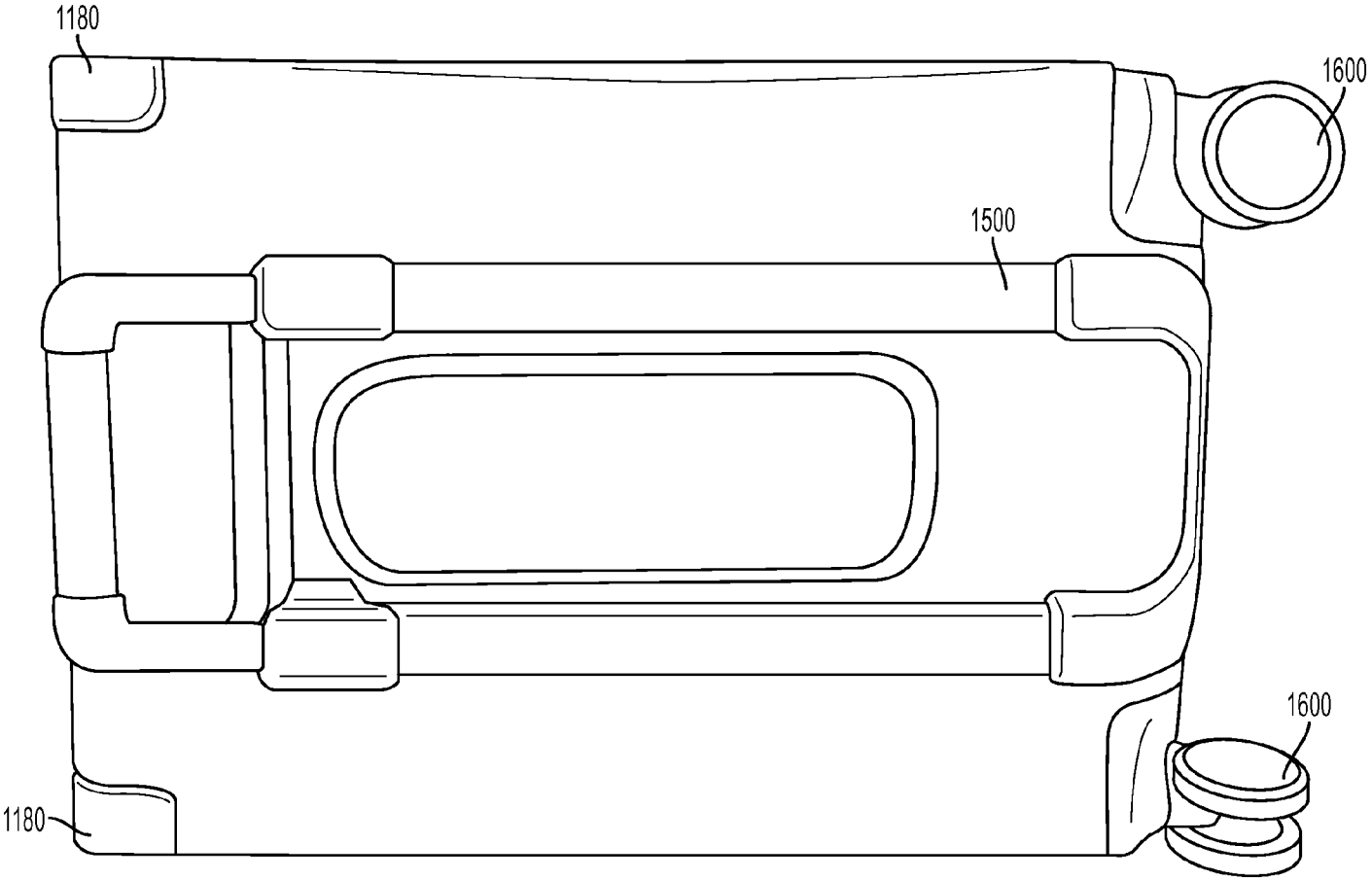
FIG. 4 is rear view of the exemplary luggage.
Figure 5:
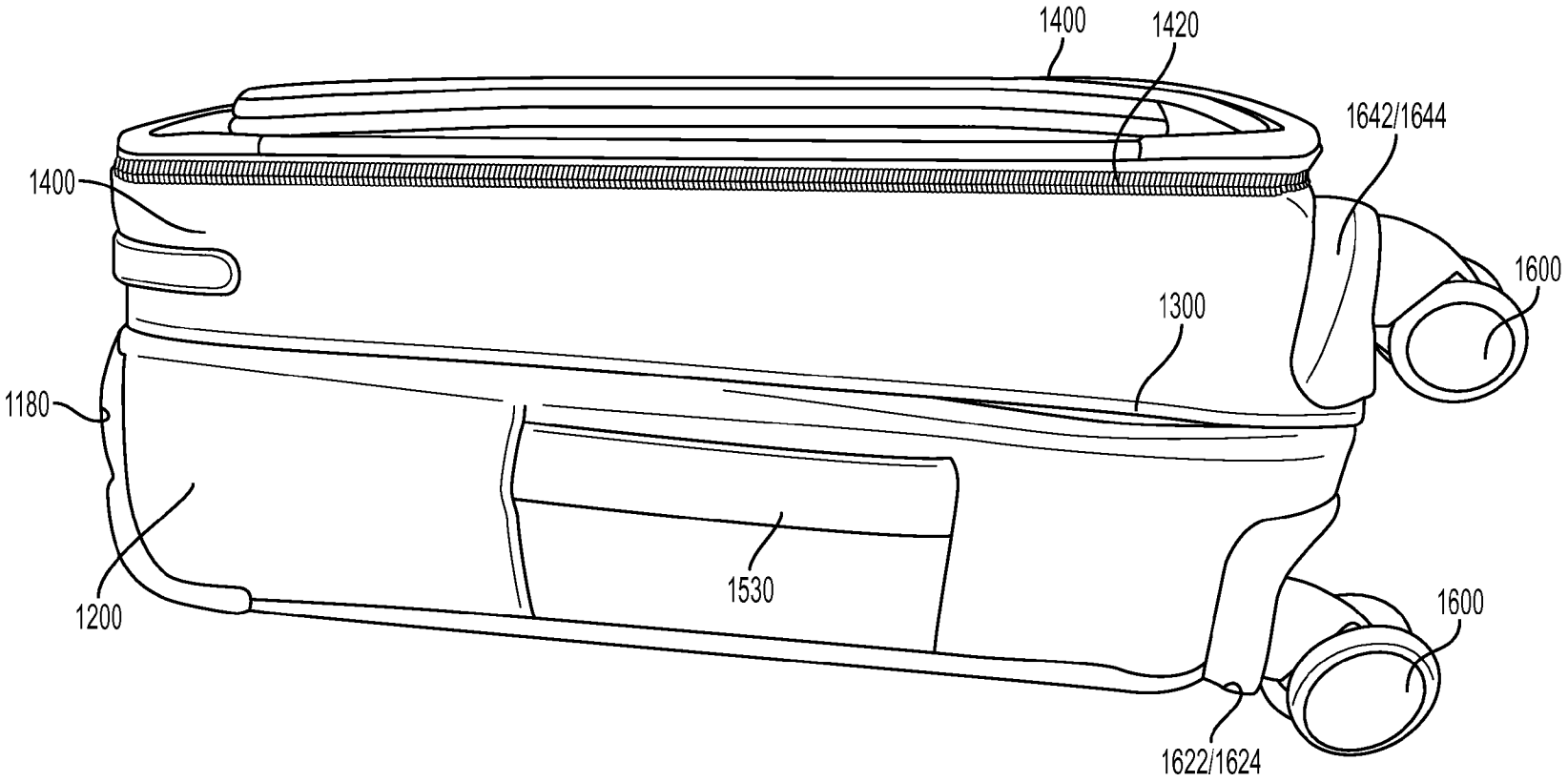
FIG. 5 is side view of the exemplary luggage.
Figure 6:
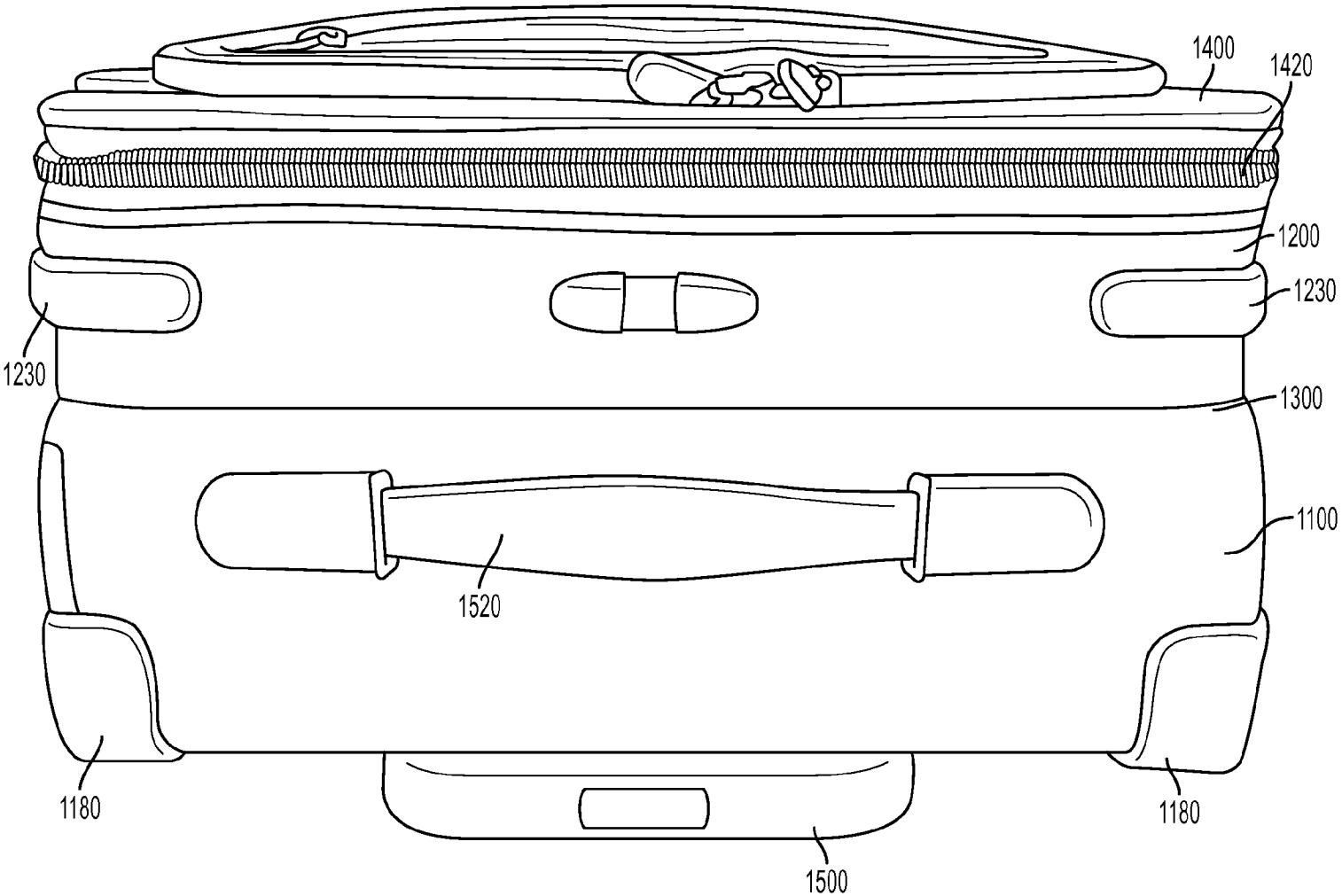
FIG. 6 is top view of the exemplary luggage.
Figure 7:
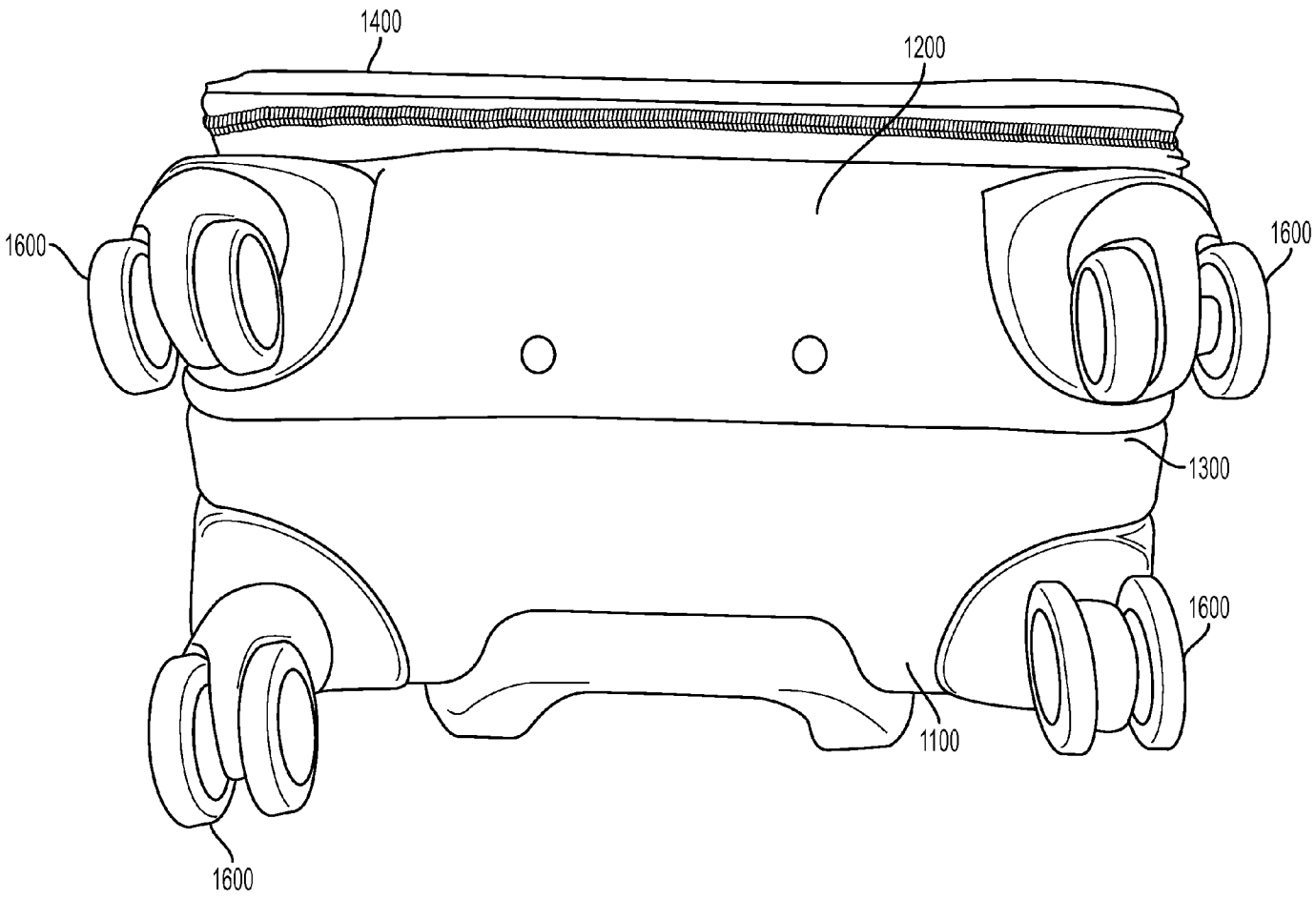
FIG. 7 is bottom view of the exemplary luggage.

As shown in FIG. 2, the main body 1100 includes a frame 1120 made of a plurality of fiberglass rods or pipes that can be substantially parallel to one another. The main body 1100 also includes a pair of opposite top brackets 1130, which are connected to the top end of the frame 1120, respectively. A top panel 1140 is provided, extending between and connected to the opposite top brackets 1130. In a similar manner, the main body 1100 includes a pair of opposite bottom brackets 1150 and a bottom panel 1160. The top brackets 1130 and the bottom brackets 1150 provide corners of the luggage 1000, to which a wheel can be mounted. The top brackets 1130 and/or the bottom brackets 1150 can be provided with receiving mechanism (such as elevations with receiving holes) corresponding to the fiberglass rods; the receiving mechanism can be molded integrally with the brackets. In addition, the top brackets 1130 and bottom brackets 1150 can have different shape, profile or material.

A covering material 1170, such as a fabric, is applied to substantially surround the frame, top and bottom brackets and top and bottom panels, to thus provide a receptacle in the shape of a half shell. One or more corner or edge guards can be provided to the main body 1100 for protecting the piping, fabric, zippers and the like of the luggage. For example, a rear corner guard 1180 can be attached to an outer surface of the covering material 1170, at a rear corner of the main body 1100 for preventing the rear corner from cracking or abrading. The corner guard 1180 can be in the shape of a curved L, or of any suitable shape or profile. In addition, multiple corner or edge guards can be utilized to protect different parts of the luggage, including the corners of the luggage, the edge of the luggage, the sides of the luggage, the top portion of the luggage and/or the bottom portion of the luggage.

The luggage 1000 further includes an extendable or retractable handle 1500. The handle 1500 can be extended or retracted to allow a user to pull or push the luggage 1000. The extendable handle 1500 can be provided externally of the main body 1100. The external handle offers certain benefits. For example, the handle can be readily accessed externally to achieve easy maintenance or replacement of the handle; the internal surface of the main body, on which the articles (such as, clothes) are packed, are generally flat to avoid wrinkles on the articles; the external handle does not affect the integrity of the receiving space within the main body, which permits the space to be used more efficiently. Alternatively, the handle 1500 can be an internal handle.

In addition, a top handle 1520 and a side handle 1530 can also be provided to facilitate lifting the luggage 1000. Additional handles, hooks, straps and the like can be provided at various positions of the luggage as deemed necessary for lifting, carrying or otherwise manipulating the luggage.

The expandable body 1200 can have a wall 1220 that defines the circumference of the frame of the expandable body 1200. The dimensions of the wall 1220 can vary. For example, the wall 1220 can have a height H of 2 inches and a thickness T of 6 mm, as shown in FIG. 2. The expandable body 1200 also includes one or more corner or edge guards 1230, which can be the same as or similar to the corner or edge guard(s) of the main body 1100 as described above. The expandable body 1200 further includes a pair of bottom corner receivers 1240, which are disposed at opposite bottom corners of the expandable body 1200.

The luggage 1000 further includes a plurality of rotational wheels 1600 mounted to the main body 1100 and/or the expandable body 1200, respectively. The rotational wheels 1600 include a first pair of wheels 1620 mounted to the main body 1100 and a second pair of wheels 1640 mounted to the expandable body 1200. For example, the first pair of wheels 1620 can be larger in size than the second pair of wheels 1640 or the wheels can be of the same size. Exemplary dimension of the rotational wheels 1600 includes but is not limited to 5"×4"×7" (12.7×10.2×17.8 cm) or 10"×10"×10" (25.4×25.4×25.4 cm); other suitable dimensions are within the scope of the disclosure. Optionally, at least one of the rotational wheels 1600 can have a brake mechanism, such that this rotational wheel can be fixed in one direction while the others can spin freely in any direction. Optionally, the rotational wheels 1600 comprise a single, swiveling wheel per corner of the main body which swiveling wheel can freely rotate 360 degrees or two, three or four wheels per corner of the main body and/or expandable body.

Referring back to FIG. 1, a three-dimensional coordinate system is defined in this figure. In this coordinate system, the X-axis and the Y-axis collectively defines a rolling surface, on which the rotational wheel 1600 can be rolled to move the luggage. The Z-axis is perpendicular to the rolling surface.

The rotational wheels 1600 are adapted to rotate individually or collectively along a rotational axis RA that is substantially parallel to the rolling surface. By means of the rotation of the wheels 1600 on the rolling surface with respect to the rotational axis RA, the luggage 1000 can be rolled or moved along opposite directions A and B within or parallel to the rolling surface. In addition, the rotational wheels 1600 are adapted to rotate individually or collectively along a spin axis SA that is substantially perpendicular to the rolling surfaces and parallel to the Z axis. The rotation of the rotational wheels 1600 with respect to the spin axis SA changes the orientation of the luggage 1000 and also the orientation of the rotational axis RA. Thus, the luggage 1000 can be move in any direction along the rolling surface.

As shown in FIG. 2, the first pair of wheels 1620 each includes a first mount 1622, through which the wheels 1620 can be fixedly mounted to the bottom brackets 1150, respectively. For example, the first mount 1622 includes a plate 1624, which can be shaped to conform to the lower external profile of the bottom bracket 1150, such that the first mount 1622 can be snugly fitted and connected to the bottom bracket 1150.

Similarly, the second pair of wheels 1640 each includes a second mount 1642, through which the wheels 1640 can be fixedly mounted to the bottom corner receivers 1240 of the expandable body 1200, respectively. For example, the second mount 1642 can include an L-shaped plate 1644, which can be snugly fitted and connected to the bottom corner receiver 1240. Although not described in detail, the wheels 1620 and 1640 can include other structures necessary for implementing a rotational wheel.

Figure 8:
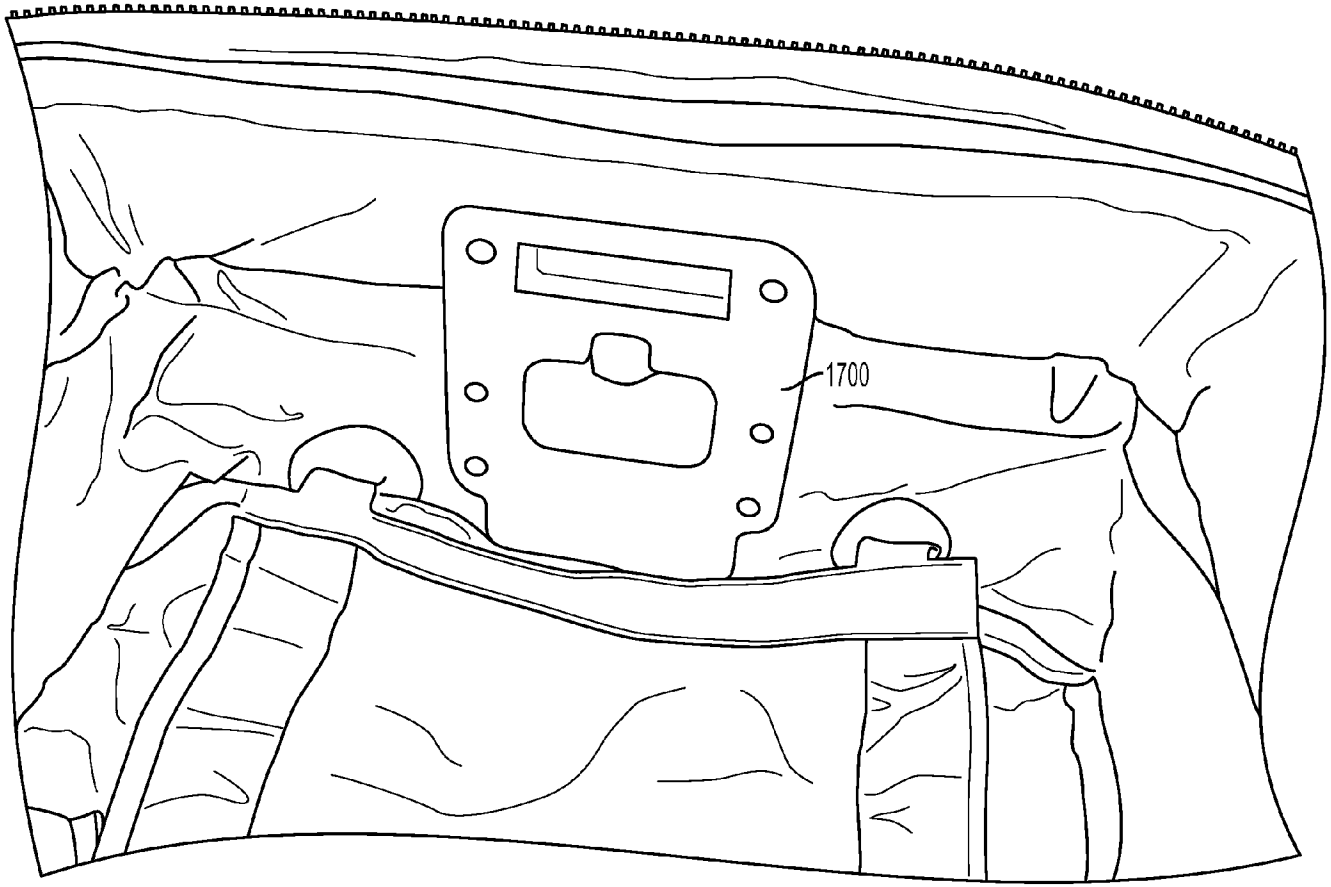
FIG. 8 is an alternative perspective view of the exemplary luggage.

As shown in FIG. 8, the luggage 1000 further includes an expansion and locking device 1700, which is a ratcheting assembly. The detailed description of the expansion and locking device 1700 is found in the co-pending and commonly owned U.S. patent application Ser. No. 13/694,191, the entire disclosure of which is incorporated herein for all purposes. The detailed description of the expansion and locking device 1700 will be provided later with reference to FIGS. 10-21. The expansion and locking device is configured to allow free movement of the expandable body in a compression direction towards the main body. Thus, upon completion of packing by the user, the user can compress the expandable body of the luggage to take up any unused space within the luggage, which results in a tightly packed luggage. Subsequently, the tightly packed articles in the luggage may apply a pressure against the expandable body; in this case, the expansion and locking device is configured to enable locking of the expandable body with respect to the main body, which prevents movement of the expandable body away from the main body in an expanding direction away. Therefore, the expandable body is locked in place.

The locking of the expandable body can be disabled by operating a release mechanism (such as, by pressing a biased lever) to selectively allow incremental movements of the expandable body away from the main body in the expanding direction. Thus, the user has the option of selectively enlarging the capacity of the luggage to pack more articles in the luggage. Once the articles have been packed in the luggage, the compression and locking operation of the expandable body, as described above, can be repeated to compact the luggage.

The provision of the rotational wheels 1600 allows the luggage 1000 to be moved freely on a surface by means of the rolling and spinning operation of the wheels. The expansion and locking device 1700 allows the luggage 1000 to be selectively expanded.

Figure 9:
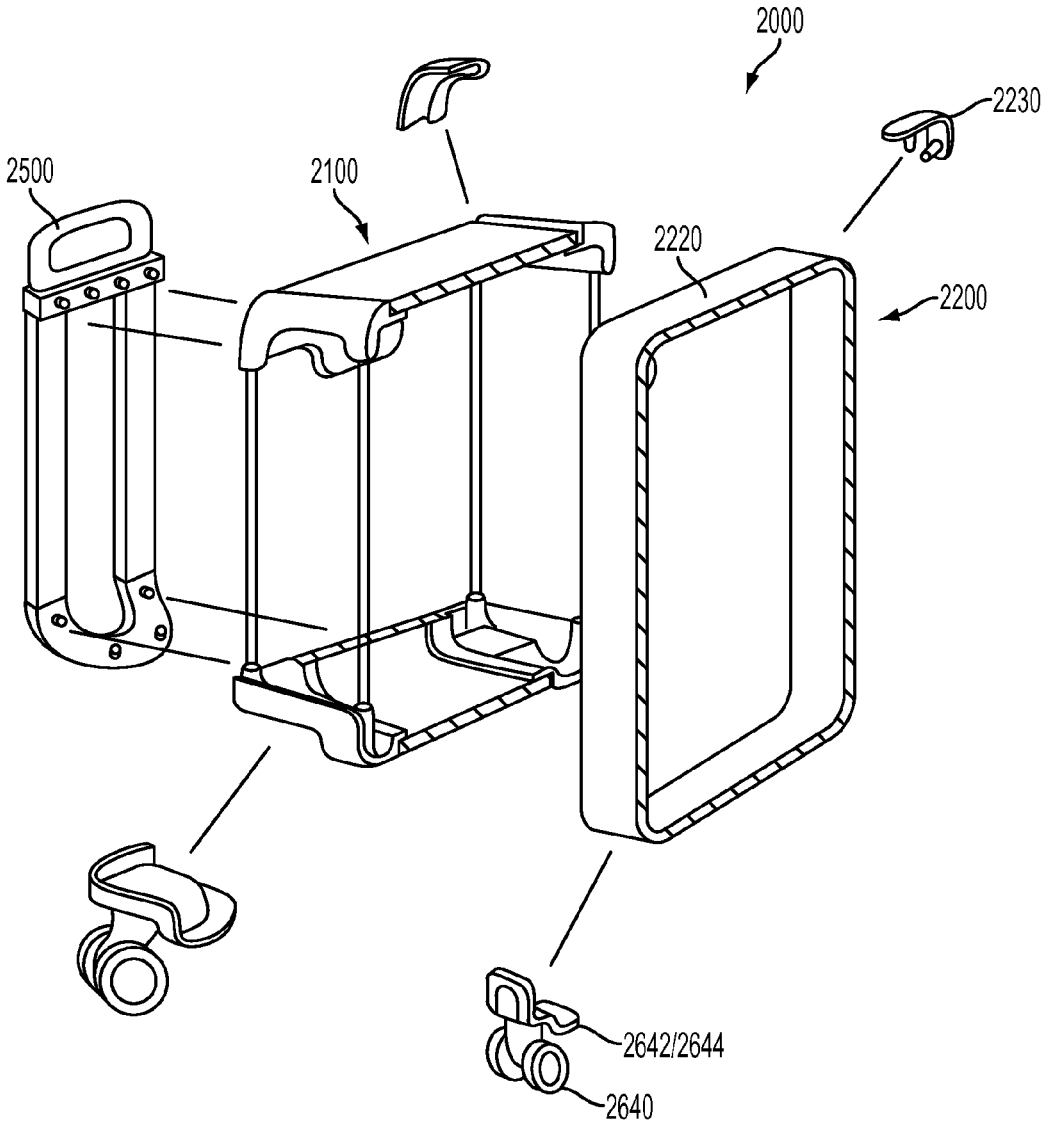
FIG. 9 is an exploded perspective view of a piece of luggage according to another exemplary embodiment of the present disclosure.

FIG. 9 is an exploded perspective view showing luggage 2000 according to another exemplary embodiment of the present disclosure. The luggage 2000 has substantially the same or similar structures and configurations as the luggage 1000, except an expandable body 2200. Description of the same or similar structures of the luggage 2000 is not provided for the purpose of conciseness. The expandable body 2200 has a wall 2220 that defines the circumference of the frame of the expandable body 2200. The expandable body 2200 also includes one or more corner or edge guards 2230, which can be the same as or similar to the guard(s) 1230. In this embodiment, the wall 2220 is continuous along the circumference of the frame to enhance the integrity of the expandable body 2200. The luggage 2000 further includes one or more rotational wheels 2640 mounted to the expandable body 2200. The size and dimension of the rotational wheels 2640 can be the same as or similar to the rotational wheels 1640 of the luggage 1000. The rotational wheels 2640 can each include a second mount 2642, through which the rotational wheels 2640 can be fixedly mounted to the bottom corners of the expandable body 2200, respectively. For example, the second mount 2642 can include an L-shaped plate 2644, which can be snugly fitted and connected to the bottom corners of the expandable body 2200.

As described above in connection with the exemplary luggage 1000 and 2000, the rotational wheels can be mounted to the main body and/or the expandable body of the luggage by using the recessed bottom brackets 1150 in combination with the shaped mount 1622, using the bottom corner receivers 1240 in combination with the L-shaped mount 1642, or using the rounded bottom corners of the continuous wall 2220 in combination with the L-shaped mount 2642. The above combinations can be used selectively depending on circumferences. For example, the main body of the luggage can have bottom corner receivers for mounting rotational wheels having an L-shaped mount; and the expandable body of the luggage can have a continuous wall with rounded bottom corners for mounting rotational wheels having an L-shaped mount.

Figure 10:
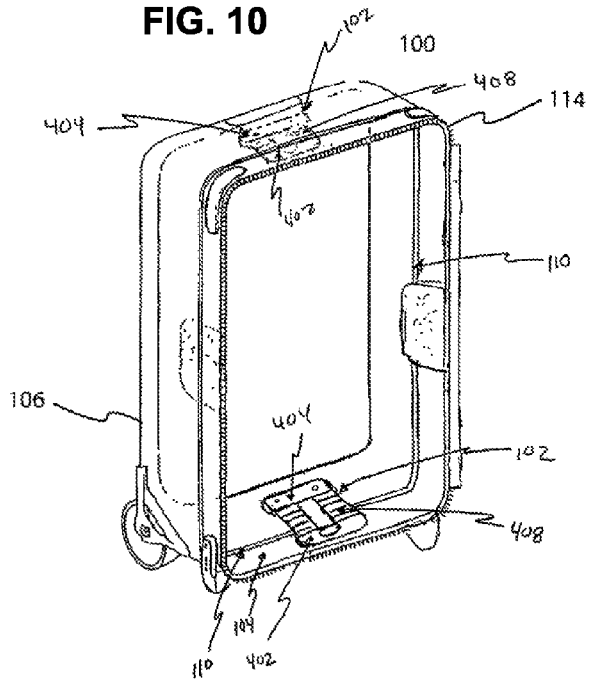
FIG. 10 illustrates a perspective view of an internal area of a luggage in accordance with yet another embodiment of the present disclosure.

Now referring to FIGS. 10-21, the details of the expansion and locking device 1700 will be described. FIG. 10 illustrates an article of luggage 100, which includes an expansion and locking device 102, also referred to herein as a ratcheting assembly. The expansion and locking device 1700 can be substantially the same as the expansion and locking device 102. The expansion and locking device 102 is mounted, respectively, at opposing inner walls of the luggage 100. The luggage 100 is formed of a luggage main body 106 coupled to an expansion body 104 by a foldable gusset 110, shown in FIG. 11. An openable cover 112 is attached to the expansion body 104 and is sealable by way of engagement of two halves of a zipper 114 provided on at least a majority of the perimeter of the cover 112 and expansion body 104.

Additionally, guide panels 108 are provide on the inside of the luggage 100 at orthogonal sides with respect to the expansion and locking device 102. The guide panels 108 are affixed to one of the luggage main body 106 or the expansion body 104, and slideably contacts the other one of the luggage main body 106 or the expansion body 104. The guide panels 108 provide lateral rigidity to the luggage when in an expanded configuration.

Figure 11:
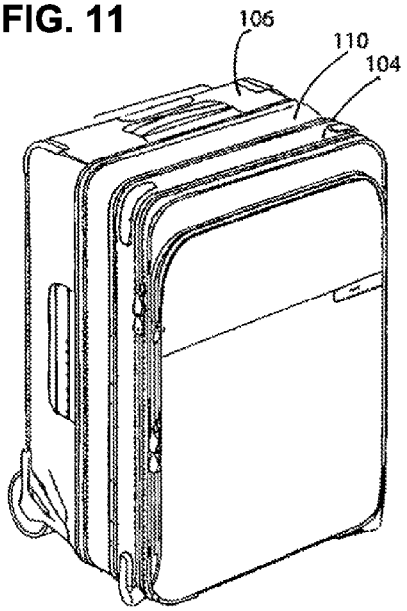
FIG. 11 illustrates a perspective view of an external area of the luggage in an expanded configuration.
Figure 12:
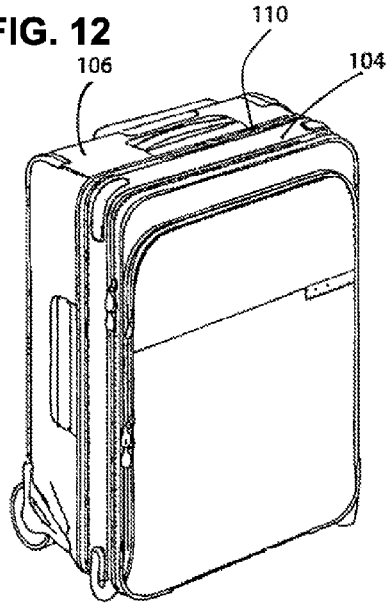
FIG. 12 illustrates a perspective view of an external area of a luggage in a compressed configuration.
Figure 13:
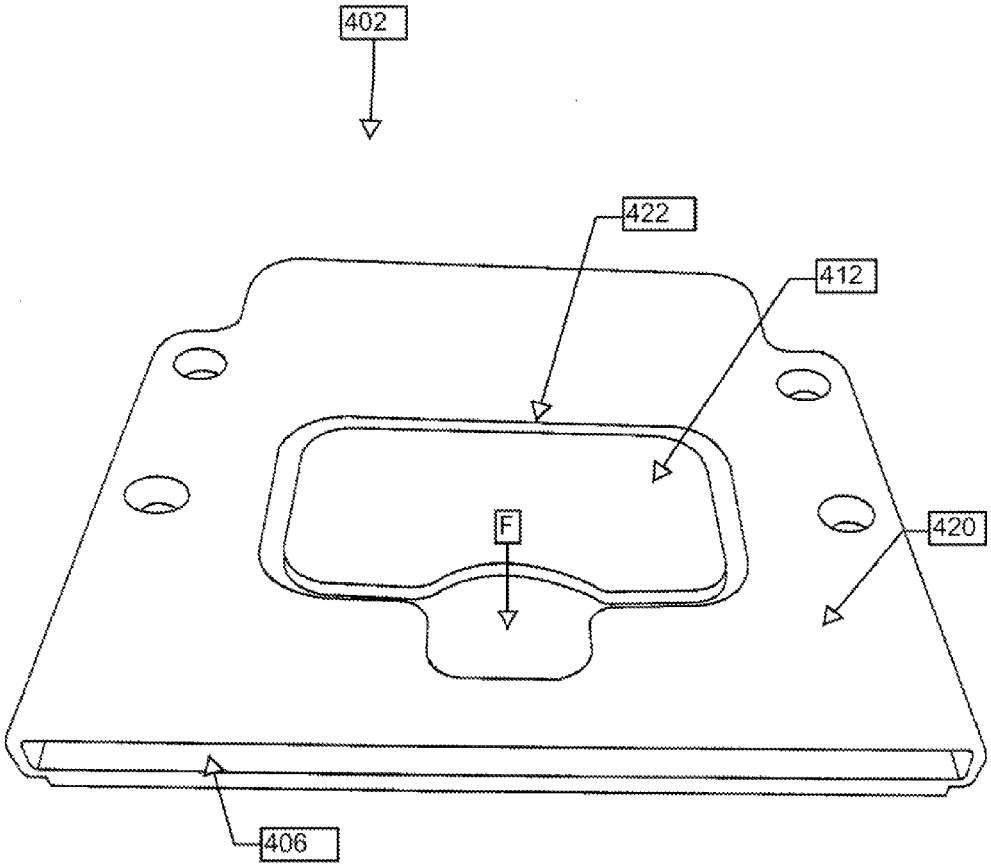
FIGS. 13-21 illustrate an expansion and locking device according to still another embodiment of the present disclosure.
Figure 14:
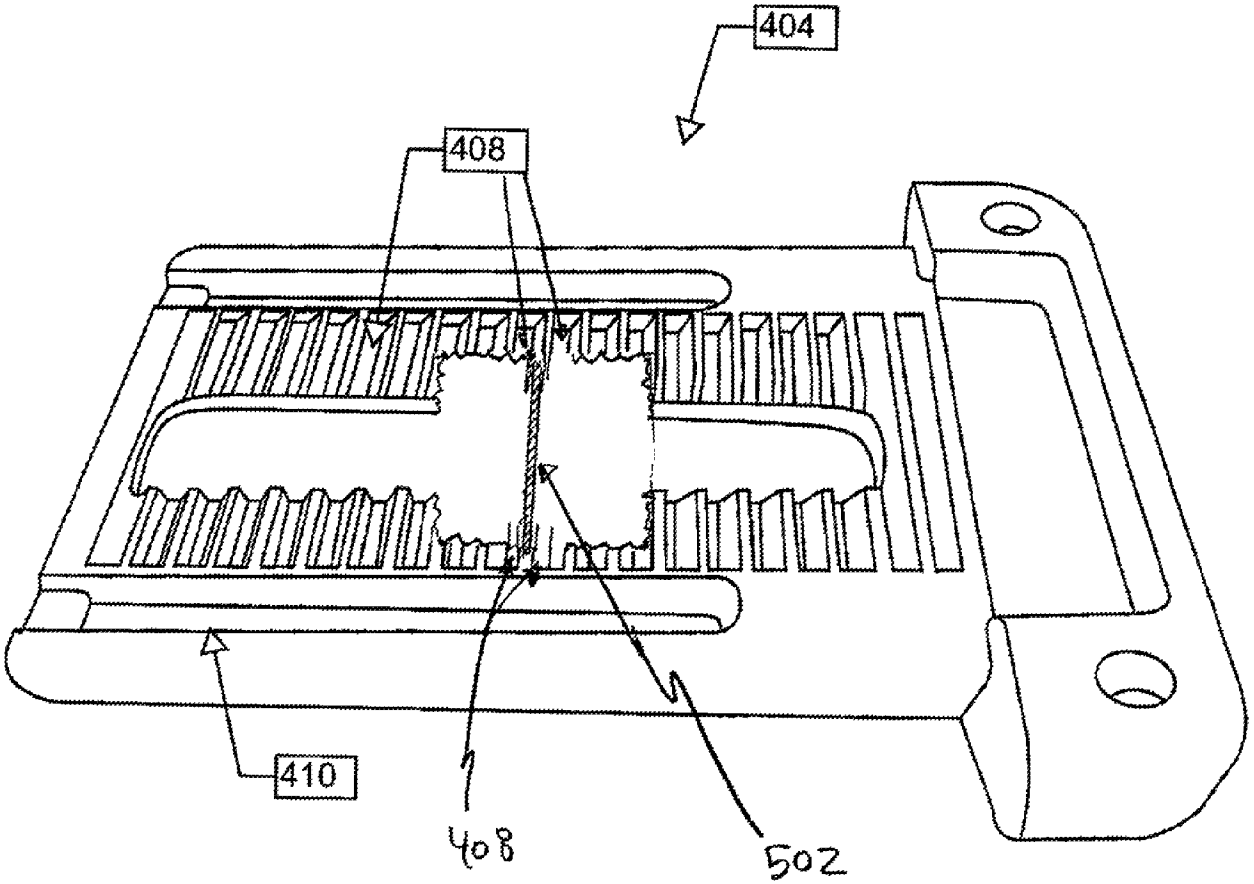
Figure 15:
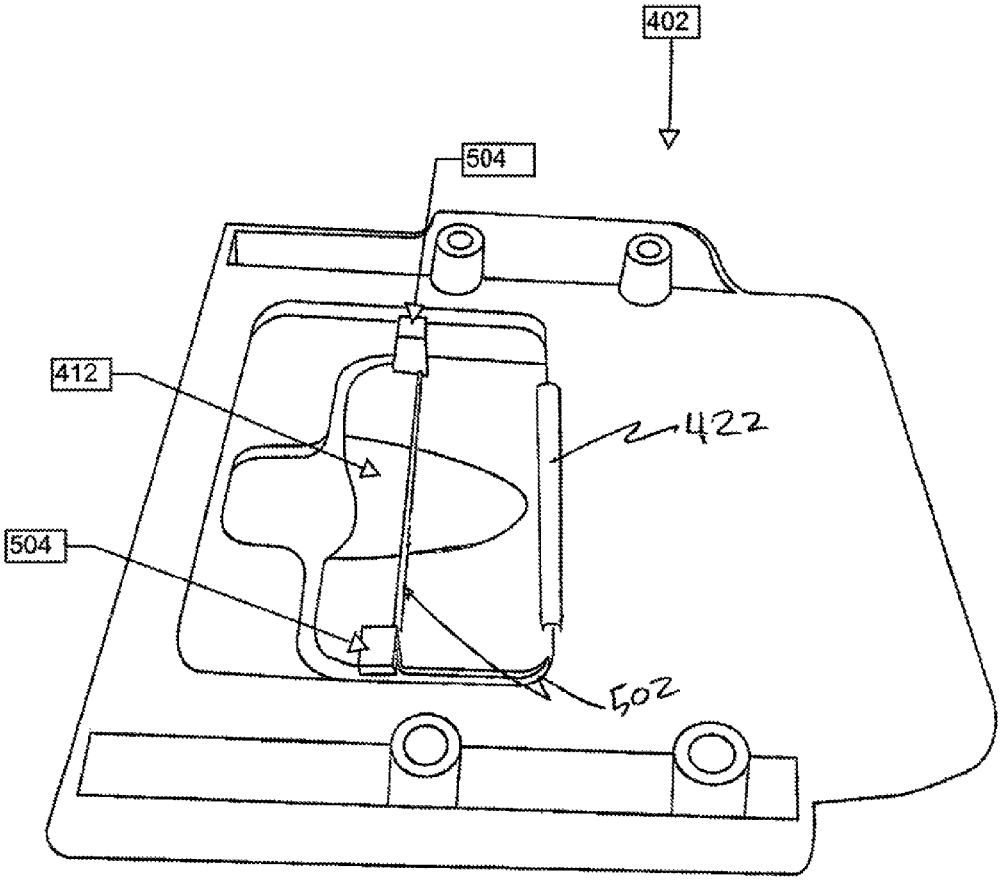
Figure 16:
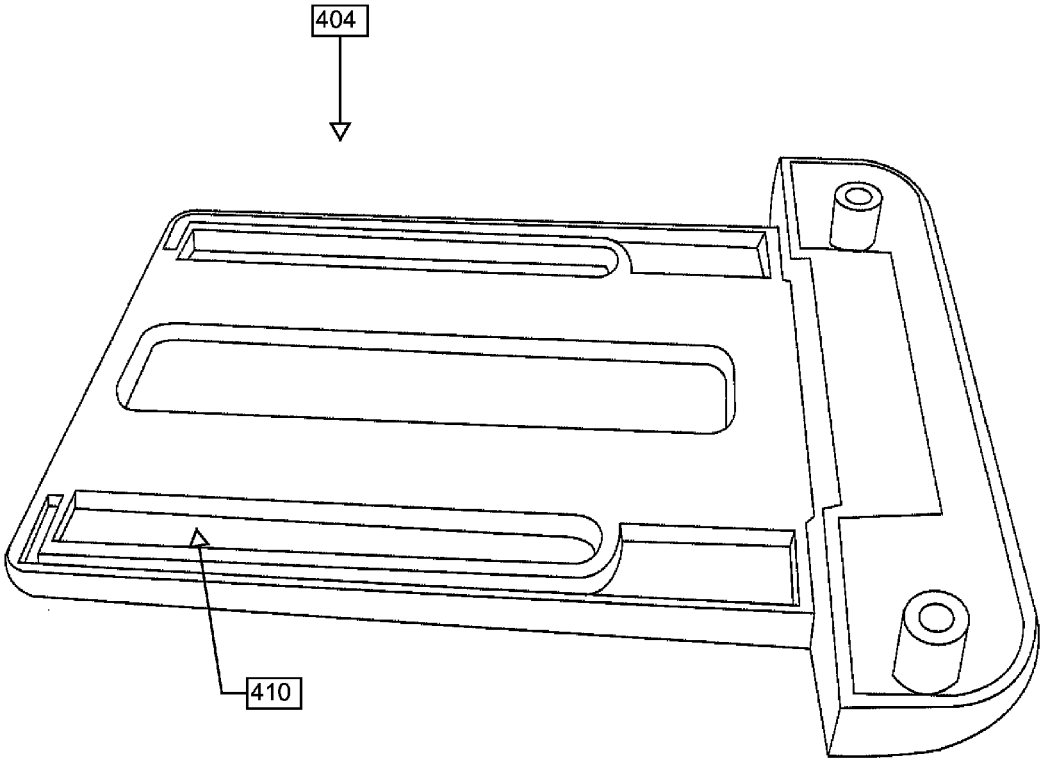

Referring to FIGS. 11 and 12, the luggage 100 is shown in an expanded state as shown by the extended aspect of the foldable gusset 110. FIG. 12 shows the luggage 100 in a compressed state in which the foldable gusset 110 is contracted bringing the luggage main body 106 and the expansion body into closer proximity.

FIGS. 13-16 show an embodiment of the expansion and locking device 102 in detail. The expansion and locking device 102 is formed of a holding assembly 402 (shown in FIGS. 13 and 15) and a sliding assembly 404 (shown in FIGS. 14 and 16) that is insertable into a receiving opening 406 formed on a surface of the holding assembly main body 420. The sliding assembly 404 includes a set of parallel teeth 408 configured to lockingly interfere with a pawl 502 (shown in FIG. 15) of the holding assembly 402. For example, the parallel teeth 408 are configured to have a surface with a mild angle in the compression direction and a nearly 90° angle formed in the expansion direction.

Additionally, travel limiting slots 410 are provided on the sliding member 406, which limit the extent of travel by the sliding assembly 404 when the travel limiting slots 410 are engage with tabs 504 (shown in FIG. 15) of the holding assembly 402.

It is noted that the pawl 502 and the tabs 504 are disposed on an underside of the holding assembly 402, and more specifically, on the underside of a latch structure 412 of the holding assembly 402. The latch structure 412 is coupled to the holding assembly main body 420 of the holding assembly 402 by a biasing member 422 integrally formed therebetween. The biasing member 422 may be formed of a live spring, coil spring or other deformable structure that provides a rest state in which the latch 412 maintains a holding force between the pawl 502 and the parallel teeth 408. The biasing member 422 allows the latch to maintain engaging force between the pawl 502 and one of the parallel teeth 408 of the sliding member 406. Additionally, when a force normal to the surface of the latch is applied to the latch as indicated by arrow F, the biasing member allows the latch structure 412 to disengage the locking member 502 from the parallel teeth 408.

The sliding member 406 is attached, by means of screws, bolts, or other fixing means, to a portion of the expansion body 104, and the holding assembly 402 is similarly affixed on a portion of the luggage main body 106 in line with the sliding member 406. In an embodiment of the present invention, two expansion and locking device 102 are provided at opposite sides of the luggage 100. However, in an alternative embodiment, one expansion and locking device 102 may be provided at each of the four sides of the luggage 100.

In an alternative embodiment, the sliding member 406 is attached by means of screws bolts or other fixing means to a portion of the luggage main body 106, and the holding assembly 402 is similarly affixed on a portion of the expansion body 104 in line with the sliding member 406.

Figure 18:
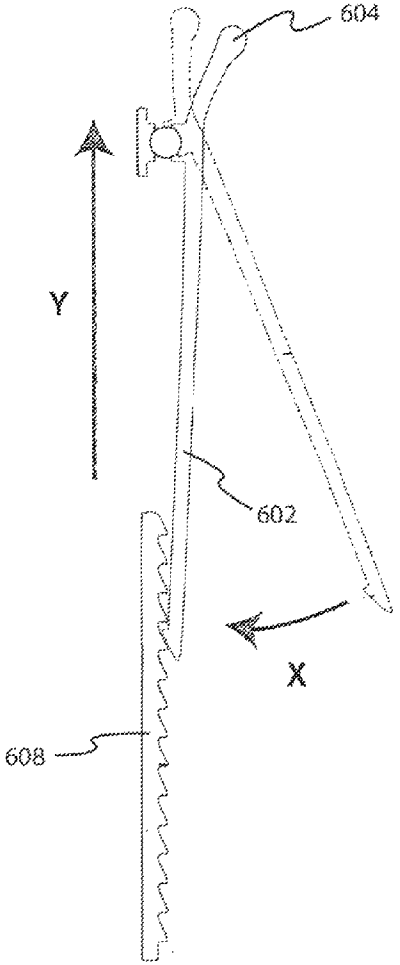
Figure 17:
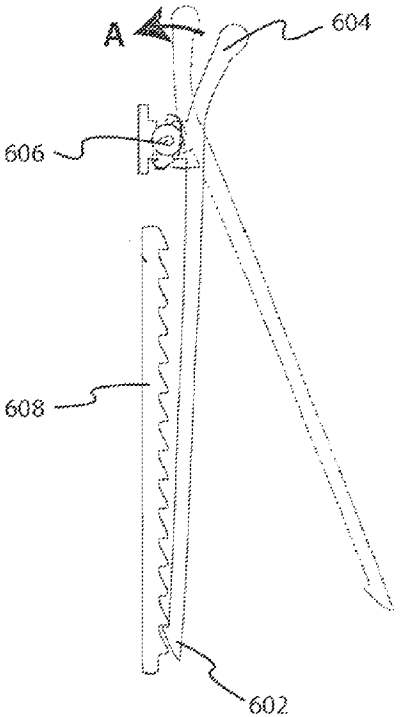

FIGS. 17 and 18 show a side view of an embodiment of the expansion and locking device 102 of the present invention. In the present embodiment, a lever 604 is provided at a first end, which facilitates engagement and disengagement of a pawl 602 disposed at an opposite end of the holding assembly with a set of parallel teeth 608. A biasing member formed as a coil spring 606 is provided at a pivot point of the holding assembly.

In the present embodiment, the holding assembly is attached to the expansion body 104 and the set of parallel teeth 608 are disposed on the luggage main body 106. When force is applied to the lever 604 in a manner to cause the rotation of the holding assembly in the direction indicated by arrow A, the pawl 602 is disengaged from the set of parallel teeth as indicated by the dashed line representation of the holding assembly. In this configuration, the holding assembly and the expansion body 104 to which it is attached are free to move along the set of parallel teeth 608 as indicated by arrow Y of FIG. 18. when the force applied at the lever 604 is removed, the holding assembly, under the force provided by the coil spring 606, re-engages the pawl 602 with the set of parallel teeth 608 as indicated by the arrow X.

In the engaged configuration, the holding assembly is free to move in the direction opposite to the arrow Y. However, the holding assembly is prevented from moving in the direction indicated by the arrow Y. In this way, the expansion body 104 and the luggage main body 106 can be compressed, but cannot be expanded. The ratcheting system provided by the present invention allows the luggage to be fully expanded by actuating the lever when the luggage is being packed. Once packed and closed, the luggage can be easily compressed by applying even force on the luggage.

Figure 19:
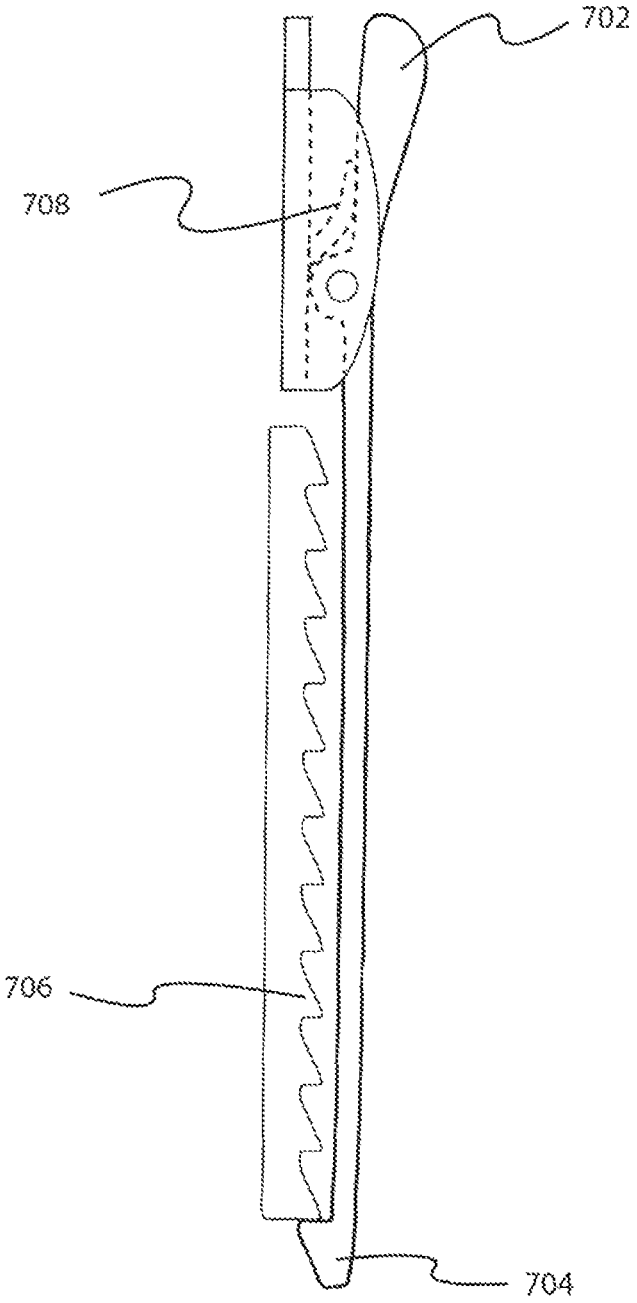

FIG. 19 shows another embodiment of the expansion and locking device 102. Similar to the embodiment shown in FIG. 17, a lever 702 is provided at a first end, which facilitates engagement and disengagement of a pawl 704 disposed at an opposite end of the holding assembly with a set of parallel teeth 706. However, in the present embodiment, the biasing member is formed of a live spring member 708 provided at a pivot point of the holding assembly. The live spring 708 is formed of a material that flexes when sufficient force is applied but returns to its original shape once the deforming force is removed.

Figure 20:
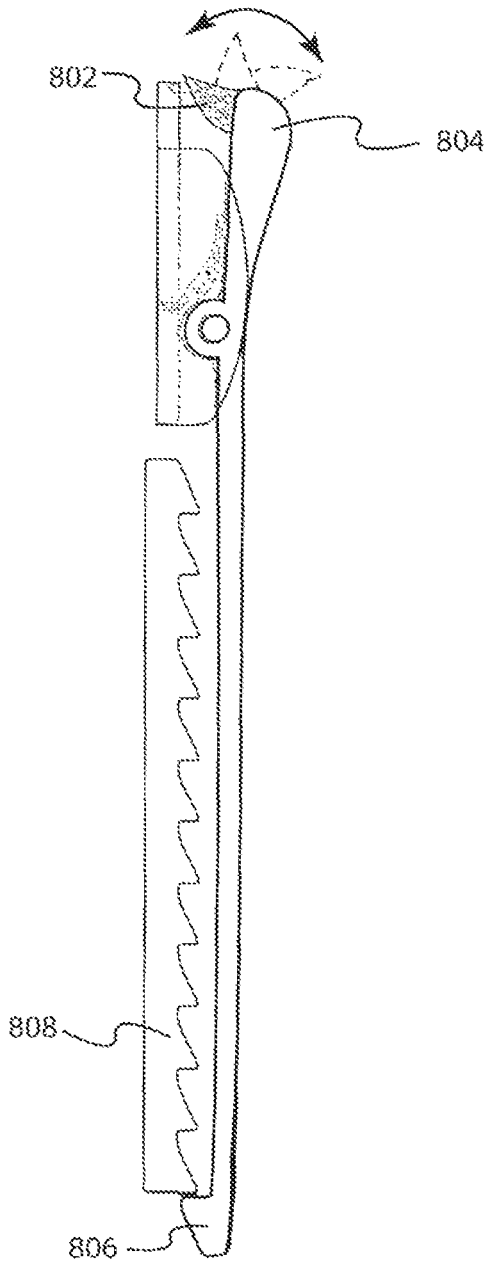

FIG. 20 shows an embodiment that is similar to the embodiment shown in FIG. 19. In the present embodiment, a lever 804 is provided at a first end, which facilitates engagement and disengagement of a pawl 806 disposed at an opposite end of the holding assembly with a set of parallel teeth 808. In addition, the present embodiment is provided with a locking mechanism 802 which is engaged by rotating the locking mechanism as indicated by the arrows. When moved to the locked position, the locking mechanism 802 prevents the lever 804 from disengaging the pawl 806 by way of an accidental application of force to the lever 804. Conversely, when the locking mechanism is rotated to the unlocked position, a force applied to the lever 804 in a manner described above, with respect to FIG. 17, causes the pawl to disengage from the set of parallel teeth 808.

Figure 21:
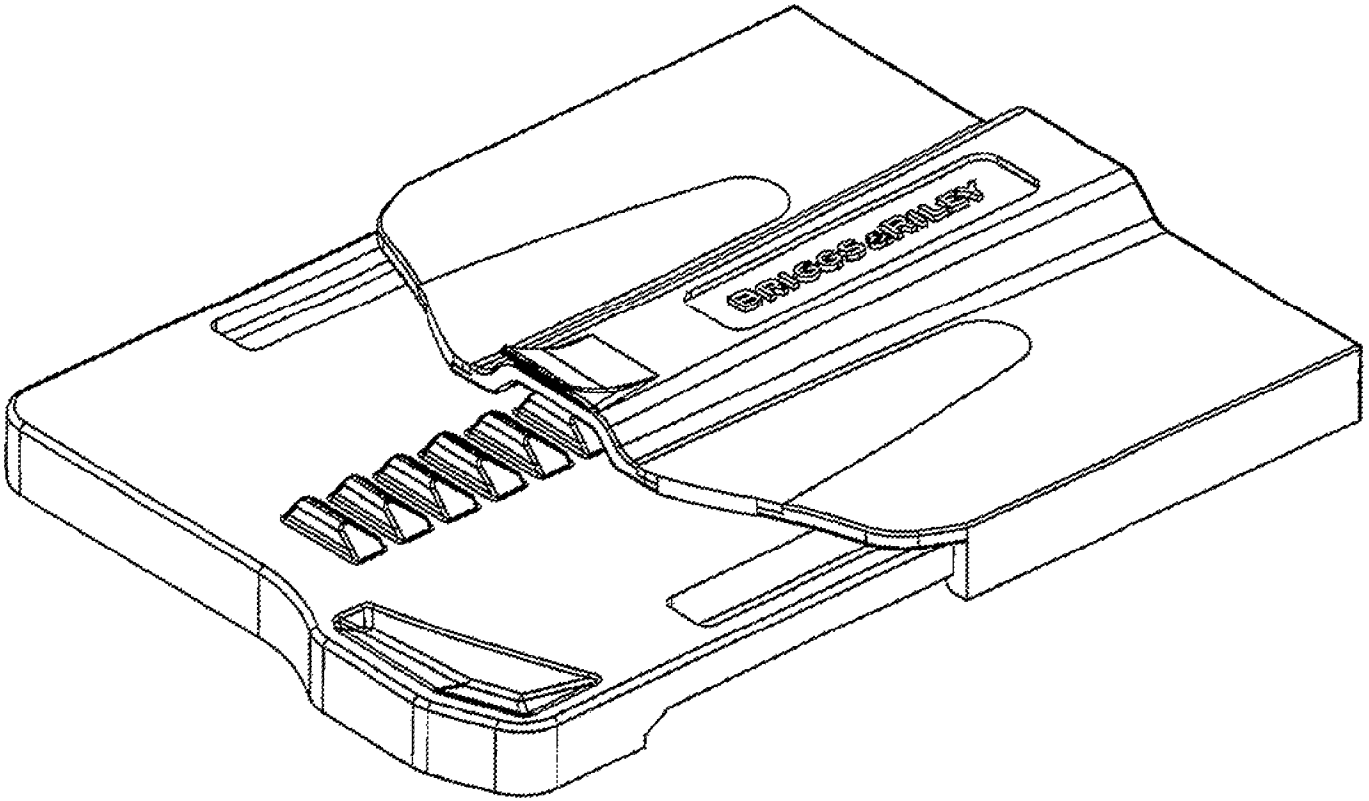

In addition to the biasing members disclosed with respect to FIGS. 13-20, alternative biasing members can be employed. For example, a rubber member maybe disposed and molded onto a portion of a lever having a pawl disposed there on, and a base surface of the holding assembly. The underlying support structure for the expansion and locking device having rubber molded thereon is shown in FIG. 21. The rubber member is not shown in order to show the supporting structure of the present embodiment. The holding assembly 14 includes a tab 16 integrally formed with one or more pawls on a bottom surface (not shown). The pawl is configured to engage with the plurality of parallel teeth 18 formed on a sliding member 12. The holding assembly is biased to provide engaging force between the pawl and the teeth 18 in a rest state, i.e., when no external force is applied to the tab 16. The indented region 22 of the holding assembly 14 are configured to receive and bond with a rubber compound forming the rubber member.

Additionally, travel limiting slots 20 are provided on the sliding member 12 as described in previous embodiments. Tabs or pins (not shown) disposed on the underside of the holding assembly 14 align with the travel limiting slots 20 and extend into the travel limiting slots 20, thus preventing the sliding member 12 from sliding beyond a predetermined range. Furthermore, the travel limiting slots 20, so configured, prevent the sliding member 12 from disengaging from the holding assembly 14.

The rubber member is of adequate thickness and resilience to require a predetermine amount of force to disengage the pawl disposed on the lever. The elastic nature of rubber allows the lever to return to an engaged rest state when the force is removed. To strengthen the bond between the surfaces of the holding assembly, through holes can be formed on the surface of the holding assembly, which allows the rubber to flow through during the molding process. In one embodiment, the rubber has a Shore A hardness value of between 60 and 65.

Acrylonitrile butadiene styrene (ABS Plastic) can be used to form the lever and pawl of the holding assembly and the set of parallel teeth. Alternatively, the components of the expansion and locking device 102 may be fabricated from metal or a combination of materials The features of the present invention as applied to various specific embodiments thereof have been shown and described. It will also be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A piece of luggage comprising:

a main body;

an expandable body that is compressible to take up unused space within the main body, the expandable body comprising a collapsible portion, the expandable body being connected to the main body through the collapsible portion;

a cover pivotably connected to the expandable body;

a plurality of rotational wheels mounted to at least one of the main body and the expandable body, wherein the luggage stands on the plurality of rotational wheels and is rotatable with respect to one or more predetermined axes through the plurality of rotational wheels; and an expansion and locking device configured to allow free movement of the expandable body in a compression direction towards the main body and allow locking movement of the expandable body in an expanding direction away from the main body, wherein the expansion and locking device comprises:

a sliding assembly having a set of parallel teeth, the sliding assembly affixed to one of the body and the expandable body; and a holding assembly main body affixed to the other of the main body and the expandable body and affixed in line with the sliding member, wherein the holding assembly main body comprises:

a receiving pocket into which the sliding assembly is insertable, wherein the receiving pocket is defined by: a proximal wall affixed to said one of the main body and the expandable body; a distal wall substantially parallel to the proximal wall; and a pair of side walls connecting the proximal wall and the distal wall; and wherein an opening is defined through the distal wall of the receiving pocket, and a latch structure pivotably coupled to the distal wall of the receiving pocket by a biasing member, the latch structure having disposed on its underside a pawl, the latch structure having a planar surface, wherein the latch structure comprises a first configuration in which the latch structure is biased by the biasing member; and when the latch structure is in the first configuration, the latch structure is disposed in the opening of the distal wall, the sliding assembly is inserted into the receiving pocket to allow engagement between the pawl and the set of parallel teeth through the opening of the distal wall, and the planar surface of the latch structure is substantially parallel to the distal wall of the receiving pocket; and wherein the latch structure comprises a second configuration in which the latch structure is pivoted by a force that is substantially perpendicular to the planar surface of the latch structure against the biasing member; and when the latch structure is in the second configuration, the pawl is pivoted away from the set of parallel teeth to release the engagement between the pawl and the set of parallel teeth, and the planar surface of the latch structure is angular with respect to the distal wall of the receiving pocket.

2. The luggage according to claim 1, wherein the plurality of rotational wheels comprises a first pair of rotational wheels mounted to the main body and a second pair of rotational wheels mounted to the expandable body.

3. The luggage according to claim 2, wherein the main body comprises: a pair of bottom brackets, to which the first pair of rotational wheels are mounted, respectively; and the expandable body comprises a pair of bottom corner receivers, to which the second pair of rotational wheels are mounted, respectively.

4. The luggage according to claim 3, wherein the first pair of rotational wheels each includes a plate adapted to conform to the shape of an external bottom surface of a respective bottom bracket, such that the first pair of rotational wheels can be snuggly connected to the bottom brackets, respectively.

5. The luggage according to claim 3, wherein the second pair of rotational wheels each includes an L-shaped plate adapted to conform to the shape of an external bottom surface of a respective bottom corner receiver, such that the second pair of rotational wheels can be snuggly connected to the bottom corner receiver, respectively.

6. The luggage according to claim 1, further comprising an extendable handle.

7. The luggage according to claim 1, further comprising at least one of a side handle and a top handle.

8. The luggage according to claim 1, further comprising at least one corner or edge guard mounted to the main body or the expandable body.

* * * * *